US005536068A

United States Patent [19]

Valentor et al.

[11] Patent Number: 5,536,068

[45] Date of Patent: Jul. 16, 1996

[54] CHAIR WITH ADJUSTABLE LEGS

[75] Inventors: Steven Valentor, Westmont, Ill.; Alan Parris, Shreve, Ohio; Shivaprasad Dhanapal, Bloomfield, N.J.; William Stephens, Norton, Ohio

[73] Assignee: Carex, Inc., Newark, N.J.

[21] Appl. No.: 337,151

[22] Filed: Nov. 9, 1994

[51] Int. Cl.[6] ..... A47C 1/02

[52] U.S. Cl. ..... 297/344.18; 297/463.1; 297/183.1; 297/188.01; 297/452.21

[58] Field of Search ..... 297/311, 337–339, 297/344.1, 344.12, 344.18, 440.1, 463.1, 183.1, 188.01, 452.21, 183.9; 248/188.4; 403/DIG. 7, 351, 296

[56] References Cited

U.S. PATENT DOCUMENTS

| | | | |
|---|---|---|---|
| 2,389,610 | 11/1945 | Christenson et al. | 403/351 |
| 2,797,738 | 7/1957 | Patterson | 297/344.18 |
| 3,512,187 | 5/1970 | Thomas et al. | 4/185 |
| 3,795,923 | 3/1974 | Thomas | 4/134 |
| 3,829,908 | 8/1974 | Thomas | 4/1 |
| 3,854,773 | 12/1974 | Thomas | 297/417 |
| 4,135,535 | 1/1979 | Thomas | 135/67 |
| 4,180,086 | 12/1979 | Thomas | 135/67 |
| 4,313,586 | 2/1982 | Grzesnikowski | 248/188.4 |
| 4,475,256 | 10/1984 | Hatala | 4/562 |
| 4,653,968 | 3/1987 | Rapata et al. | 248/188.4 X |
| 4,948,197 | 8/1990 | Sansing | 297/344.18 X |
| 5,031,869 | 7/1991 | Strater et al. | 248/188.4 X |
| 5,040,758 | 8/1991 | Giovannetti | 248/188.4 |
| 5,335,377 | 8/1994 | Masyada et al. | 297/440.1 X |

OTHER PUBLICATIONS

Guardian Composite Shower Chair—Guardian, 4175 Guardian St., Simi Valley, CA 93062 Nov. 1993—4 pages.

*Primary Examiner*—Milton Nelson, Jr.
*Attorney, Agent, or Firm*—Renner, Kenner, Greive, Bobak, Taylor & Weber

[57] ABSTRACT

A chair (10) having adjustable height includes a seat (11) and a number of leg members (12). An adjusting mechanism (30) includes an insert sleeve (40) received within a hollow area (31) of a leg member (12). The insert sleeve (40) has an internal thread (52) which threadably receives a leg extension (60) having an external thread (61). Rotation of the leg extension (60) within the sleeve (40) adjusts the length of the leg member (12).

10 Claims, 3 Drawing Sheets

CHAIR WITH ADJUSTABLE LEGS

TECHNICAL FIELD

The present invention is directed toward a chair having adjustable legs such that the height of the chair can be varied. Specifically, the invention relates to a chair, such as used in bathtubs, the height of the legs which can be varied by turning threaded leg extensions inserted into a chair leg.

BACKGROUND OF THE INVENTION

The present invention is an improvement in a chair having adjustable height legs. Such a chair might be useful, for example, as a bathroom safety chair. More particularly, the present invention can be used in, for example, bathtubs or shower stalls such that a user can sit in the chair and bathe and shower with increased comfort and/or safety. Shower chairs are known in the art and are normally fabricated from a plastic material. Such chairs are useful for use with persons having decreased mobility or a desire for added comfort during showering.

It is also known in the art that the user of such chairs often find a benefit if the chair is of adjustable height. Therefore, a number of adjustable height bath chairs have been developed. For example, U.S. Pat. No. 4,475,256 discloses a shower transfer bench having a telescoping leg which locks in place with use of a locking button which can be selectively positioned in one of a series of locking holes associated therewith. The user selects the desired height of the bench by sliding an inner leg within an outer leg, and positioning the locking button in one of the locking holes carried by the outer leg. The leg is then locked at the desired location.

The telescoping/locking pin means of adjusting the height of a device such as a chair provides an effective means for height adjustment. However, such devices often prove difficult for a person with decreased manual dexterity to operate effectively. In order for the telescoped leg to be sufficiently locked at the desired location, the locking pin is often biased into the locking hole with great force. A person requiring a shower chair because of feebleness due to injury or the like, will often find manipulating a locking pin/locking hole arrangement very difficult.

A further drawback with such height adjusting devices is that if they are to be made of a plastic or other polymeric material, the adjusting mechanism components must normally be extensively machined or molded with complex molds. This increases the production times and costs for such devices.

Another means of adjusting the height of shower chairs has included the simple placement of a shoe under the chair legs. By selecting a shoe of appropriate height, the height of the shower chair can be adjusted. Such a system provides an efficient means of height adjustment with a minimum of manual dexterity, and hence is a very effective means for accomplishing the task. However, a drawback with this type of height adjustment is that in order to provide for a wide range of height adjustments, a large number of shoes would be required. That is, at each preselected height, four shoes would be required for a four legged chair.

Thus, the need exists for a safety and comfort shower chair the height of which can be selectively adjusted without the need for the placement of additional parts upon the device and without the need for great manual dexterity.

DISCLOSURE OF INVENTION

It is thus a primary object of the present invention to provide a chair having legs which can be adjusted to change the height of the chair.

It is another object of the present invention to provide a chair, as above, which can be used as a bath or shower chair.

It is a further object of the present invention to provide a safety/comfort chair, as above, the height of which can be adjusted without the need for great manual dexterity.

It is yet another object of the present invention to provide a height adjustable chair, as above, which can be assembled from simply molded components without the need for extensive machining.

These and other objects of the present invention, as well as the advantages over the known art, which shall become apparent from the description which follows, are accomplished by the invention as hereinafter described and claimed In general, a chair having adjustable height includes a seat portion having a plurality elongate leg members extending generally downwardly from the seat portion for supporting the seat portion. Each leg member has a first and second ends, the first ends positioned proximate to the seat portion. At least one of the leg members has a generally longitudinally extending insert-receiving hollow area therein and an aperture at its second end opening into the hollow area. An internally threaded insert is receivable within the insert-receiving hollow area, and a leg extension member is threadably received within the internally threaded insert means. The height of the at least one leg member is adjustable by threadably rotating the leg extension within the insert means.

A preferred exemplary chair having an adjustable height incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
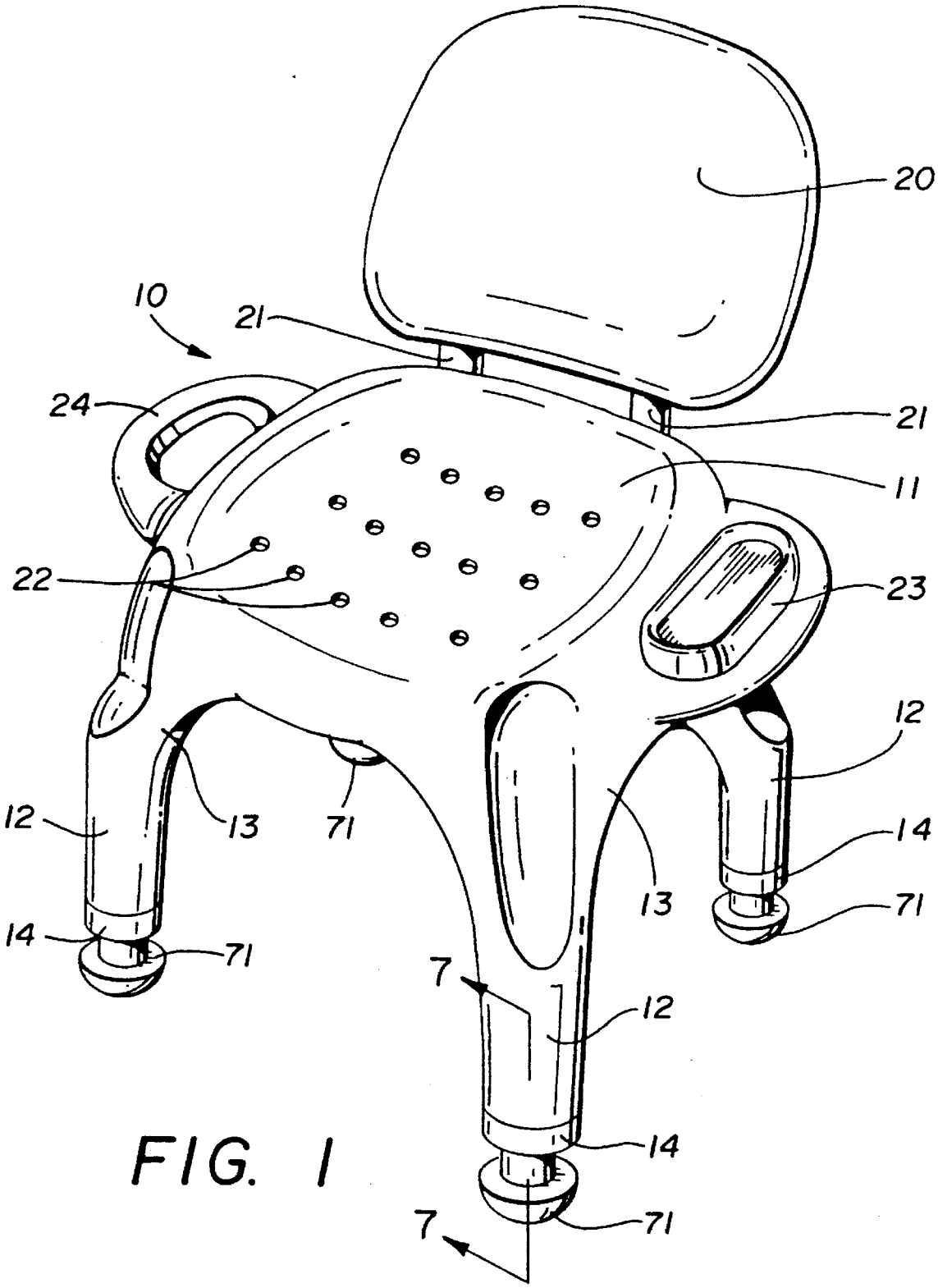
FIG. 1 is a perspective view of a chair with adjustable height made in accordance with the concepts of the present invention.
Figure 2:
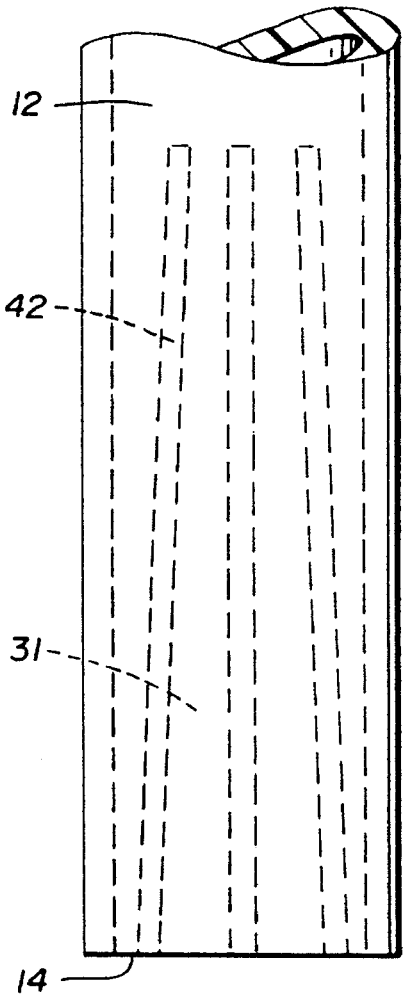
FIG. 2 is a fragmented view of one leg member of the chair of FIG. 1, showing internal structure therein by phantom lines.
Figure 3:
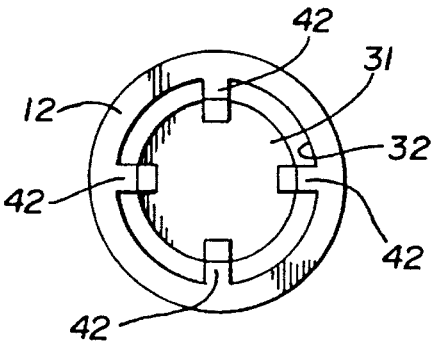
FIG. 3 is a bottom plan view of the leg member of FIG. 2.

A chair having an adjustable height is indicated generally by the numeral 10 on the attached drawings. Chair 10 is somewhat conventional in that it has a seat portion 11, and four downwardly extending leg members 12. Leg members 12 are generally elongate, supporting seat portion 11 at one end 13 and being placed proximate to a support surface such as a floor (not shown) at the other end 14. A chair having any number of leg members 12 is within the scope of this invention.

Chair 10 may also, optionally, be configured with a back support 20, such as may be carried by supports 21 affixed to seat portion 11. When used as a shower chair, chair 10 may be advantageously provided with drain holes 22 in seat portion 11, a soap dish 23 and a handle 24. Preferably, chair 10 is molded from a plastic material, such that soap dish 23 and handle 24 may be integrally formed therewith.

Figure 6:
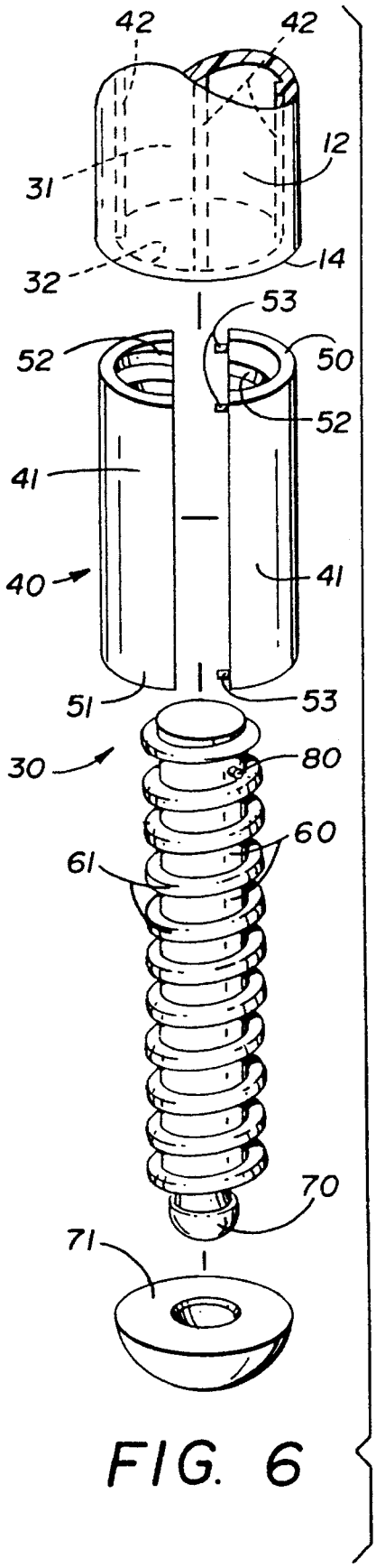
FIG. 6 is an exploded, fragmented view of one leg member of FIG. 1, showing the height adjusting mechanism thereof.
Figure 4:
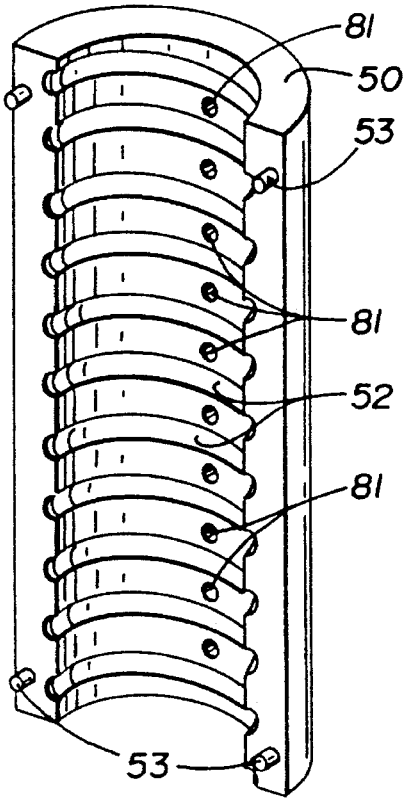
FIG. 4 is a perspective view of one portion of an insert sleeve used in a height adjusting mechanism according to the invention.
Figure 5:
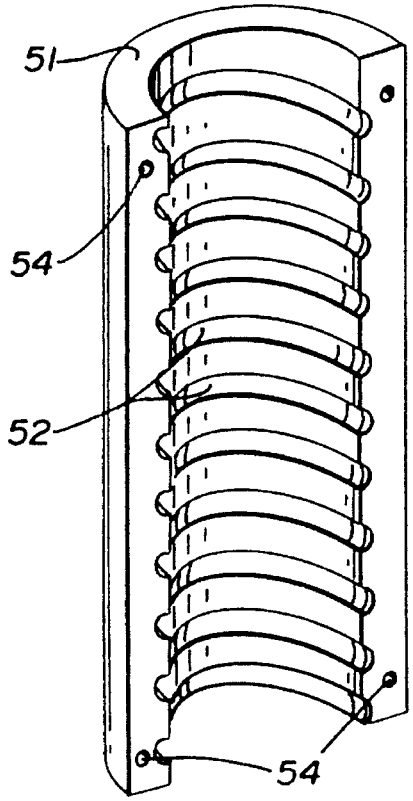
FIG. 5 is a perspective view of a complimentary portion to the insert sleeve shown in FIG. 4.

The height adjusting mechanism generally indicated by the number 30 (FIG. 6), is housed substantially within each leg member 12. That is, at least one and preferably all leg members 12 include a height adjusting mechanism 30 in a manner to now be described. For the sake of the present discussion, reference will be made to a singular leg member 12 as part of the height adjusting mechanism 30, it being understood that more than one or all leg members 12 may be similarly configured.

As briefly discussed hereinabove, it is an object of the invention to provide a chair having adjustable height without the need for extensive machining or complex molding operations. To accomplish this purpose, the invention makes use of a number of cooperating components each of which can be easily molded. The cooperative interaction of the components provides a chair having adjustable height. The result is also a chair 10 that can be easily assembled and adjusted for height without the need a high degree of physical dexterity.

Leg members 12 are provided with a generally longitudinally extending hollow area 31 therein. Hollow area 31 may be thought of as a "bore" within leg member 12, although no connotation of being round is necessarily to be imparted by the term. Hollow area 31 extends within leg member 12 in a direction parallel to the elongate dimension of leg member 12. For reasons to be more fully discussed below, it is also preferred that hollow area 31 is inwardly and upwardly tapered from a widest portion proximate to lower end 14 of leg member 12, to a smallest portion distal thereto. Hence, hollow area 31 is preferably conically shaped. End 14 of leg member 12 thus has an aperture 32 opening to hollow area 31 such that access to hollow area 31 may be obtained through aperture 32.

Receivable within hollow area 31 through aperture 32 is an insert sleeve generally indicated by the numeral 40. It is preferred that insert sleeve 40 is held in place within hollow area 31 by friction between the outer wall 41 of insert sleeve 40 and the walls of hollow area 31. In order to further increase the friction fit of insert sleeve 40 within hollow area 31, hollow area 31 may be provided with rib members 42 extending within leg member 12 and protruding into hollow area 31. Any number of rib members 42 may be included in a given leg member 12, four being a preferred number as depicted in the drawings. Rib members 42 serve not only to position insert sleeve 40 within hollow area 31, but also reduces the number of points of contact between the walls of hollow area 31 and outer wall 41 of insert sleeve 40. Thus, the friction fit between insert sleeve 41 and leg member 12 is further enhanced. It will be appreciated that any manner of securing insert sleeve 40 within leg member 12 is within the scope of the invention. Thus, insert sleeve 40 may be threadably received within leg member 12, adhesively bonded thereto, or the like.

In order to aid in the ease of manufacture and the ultimate assembly by a user, insert sleeve 40 is preferably formed from at least two separate, complimentary portions 50 and 51. Each complimentary portion 50, 51 carries a section of a female thread 52. When both complimentary portions 50 and 51 are brought together in an opposing, proximate and preferably physically engaging relation, the completed insert sleeve 40 having internal thread 52 is formed. To aid in the proper positioning of complimentary portions 50 and 51 with respect to one another, positioning pins 53 may be provided in selected locations, such as the approximate corners, on complimentary portion 50. Corresponding to positioning pins 53 are positioning apertures 54 formed in the other complimentary portion 51. By inserting pins 53 within apertures 54, the proper position of complimentary portions 50 and 51 is assured. Once complimentary portions 50 and 51 have been brought together to form insert sleeve 40, insert sleeve 40 may be inserted into and thus, received within, hollow area 31 through aperture 32 as was discussed hereinabove.

Figure 7:
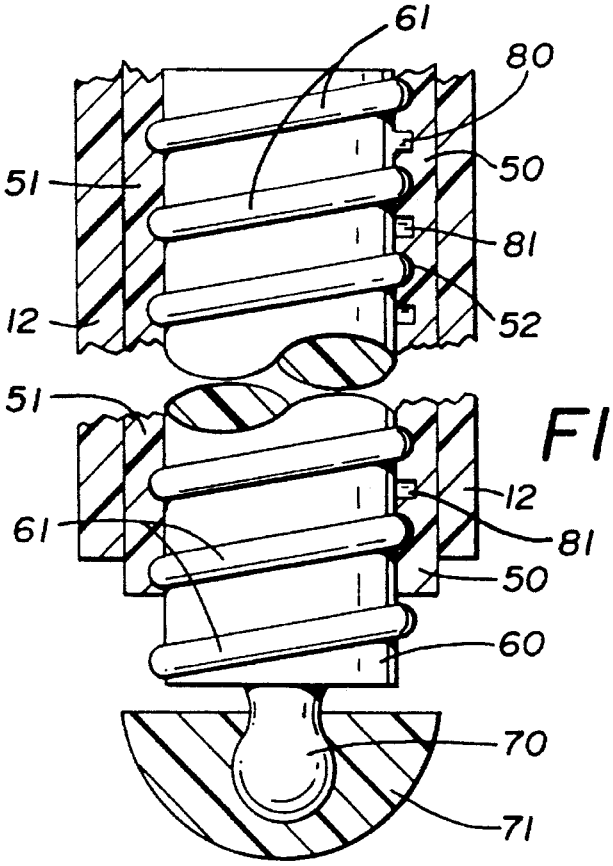
FIG. 7 is a fragmented sectional view taken substantially along line 7—7 of FIG. 1 and depicting one portion of the adjusting mechanism of FIG. 6, shown in an engaged position.

Adjusting mechanism 30 also includes a leg extension 60. Leg extension 60 is preferably elongate and has a male thread 61 disposed on the outer portions thereof. It is preferred that male thread 61 be continuous, although this is not necessary to the invention. External thread 61 is complimentary to internal thread 52 of insert sleeve 40, as depicted in FIG. 7. By inserting leg extension 60 into insert sleeve 40 which is received within hollow area 31 of leg member 12, the assembled adjusting mechanism 30 is formed. In order to facilitate its use as a leg on a support surface, leg member 12 may be provided with a foot 70 having a cap 71 affixed thereto. One preferred cap 71 fits by a press fit onto foot 70.

To adjust the height of leg member 12 and thus the height of seat portion 11 supported thereby, it is merely necessary to rotate leg extension 60. The threaded engagement of external thread 61 with internal threads 52 of insert sleeve 40 will cause the position of leg extension 60 to be varied during such rotation. That is, leg extension 60 can be threaded into insert sleeve 40 in a manner conventional with threaded engagements, and hence into leg member 12, thus lowering the height of leg member 12. Similarly, leg extension 60 can be threaded in a direction out of insert sleeve 40 and leg member 12, thus raising the height of leg member 12. The height of seat portion 11 is thereby adjusted.

In use, a user may assemble chair 10 by first aligning complimentary portions 50 and 51 of insert sleeve 40. If employed, the positioning pins 53 and apertures 54 are correspondingly engaged. The completed insert sleeve 40 is then inserted into hollow area 31 through aperture 32. The friction between the interior of leg member 12 and insert sleeve 40, and more particularly between insert sleeve 40 and rib members 42 (if employed) will generally cause insert sleeve 40 to be retained within hollow area 31. The manufacturer will normally preselect the dimensions of hollow area 31 and insert sleeve 40 to ensure a proper friction fit, and specific such dimensions are not necessarily a limitation of the invention. The weight of the user will normally be sufficient to properly seat insert sleeve 40 within hollow area 31.

Leg extension 60 is then inserted into insert sleeve 40, and threadably engaged therein until the desired height of leg member 12 is achieved, the height being adjusted as described hereinabove.

In a preferred embodiment of the invention, there is provided a means of calibrating the position of each leg extension 60 within insert sleeve 40, and hence of calibrating the height of seat portion 11. In this regard, leg extension 60 can be provided with a calibrating protrusion 80 extending laterally therefrom. Preferably, calibrating protrusion 80 is positioned on the root of external thread 61 of leg extension 60. Insert sleeve 40 can also be provided with a series of regularly spaced calibrating detents 81. Preferably, calibrating detents 81 are disposed on the crest of internal thread 52. When leg extension 60 is threaded into insert sleeve 40, it is threadably rotated until calibrating protrusion 80 aligns in an opposing manner with a calibrating detent 81. Preferably, calibrating detent 81 is formed from a slightly deformable plastic, elastomeric or other polymeric material, such that it is slightly deformed against the crest of internal thread 52 during the threading rotation of leg extension 60 within insert sleeve 40. When calibrating protrusion 80 aligns with a calibrating detent 81, calibrating protrusion 80 substantially returns to original shape and protrudes into calibrating aperture 71. The result is that the user will feel a slight "snapping" or tugging sensation each time calibrating protrusion 80 engages or disengages from a calibrating detent 81. A "clicking" sound may also be present to signal the engagement or disengagement. The protrusion/detent system also can be utilized to assure that each of the leg members is adjusted to the same height. That is, if the user knows that one leg has been adjusted through, for example, two protrusion/detents, then the other legs can be similarly adjusted.

By properly spacing the position of a plurality of calibrating detents 81, the height adjustment of chair 10 can be estimated by the user. For example, preselected spacing of calibrating detents 81 may be made such that each complete turn of leg extension 60 lowers or raises leg extension 60, and hence, seat portion 12, one inch, one-half inch, or the like. Any number of calibrating protrusions 80, detents 81 or the locations thereof can be employed to achieve any desired calibration.

The height to which chair 10 may be raised or lowered is determined by the length of leg members 12, the dimensions of hollow area 31 therein, the length of insert sleeve 40, the length of leg extension 60, and the like, all of which can be varied and preselected to substantially any degree and remain within the scope of the invention.

The present invention is therefore, a novel and unique improvement over the known art. It is thus evident that an adjustable chair constructed in accordance with the concepts of the present invention accomplishes the objects of the invention and substantially improves the art.

What is claimed is:

1. A chair having adjustable height comprising a seat portion, a plurality of elongate leg members extending generally downwardly from said seat portion for supporting said seat portion each said leg member having a first end and a second end, said first and positioned proximate to said seat portion, at least one of said leg members having a generally longitudinally extending insert-receiving hollow area therein and an aperture at said second end opening into said hollow area, an internally threaded insert member having an outer surface and being receivable within said insert-receiving hollow area, said at least one of said leg members having a plurality of spaced longitudinally extending rib members extending into said insert-receiving hollow area, such that only said rib members physically engage said outer surface of said insert member when said insert member is received within said hollow area, and a leg extension member threadably received within said internally threaded insert member such that the height of said at least one of said leg members is adjustable by threadably rotating said leg extension member within said insert member.

2. A chair as in claim 1 wherein said insert-receiving hollow area is inwardly tapered from said aperture.

3. A chair as in claim 1 wherein said insert member includes first and second complimentary portions, each said portion carrying a section of a corresponding thread, such that said complimentary portions are positionable in a proximate position to form a substantially continuous thread therebetween.

4. A chair as in claim 3 wherein said first complimentary portion is provided with a positioning aperture and second complimentary portion carries a positioning pin, such that when said first and second complimentary portions are placed in a proximate position, the alignment thereof is guided by insertion of said positioning pin within said positioning aperture.

5. A chair as in claim 3 wherein said thread of said first and second complimentary portions are female threads.

6. A chair as in claim 5 wherein said leg extension member carries an external male thread corresponding to said female thread of said insert member.

7. A chair as in claim 6, further comprising a plurality of regularly spaced calibrating detents positioned on the crest of said female thread.

8. A chair as in claim 7 wherein said leg extension member also includes at least one outwardly extending calibrating protrusion positioned on the root of said external thread and receivable within a selected one of said detents carried by said insert member, when said leg extension member is threadably received within said insert member.

9. A chair having adjustable height comprising a seat portion, a plurality of elongated leg members extending generally downwardly from said seat portion for supporting said seat portion, each said leg member having a first end and a second end, said first end positioned proximate to said seat portion, at least one of said leg members having a generally longitudinally extending insert-receiving hollow area therein and an aperture at said second end opening into said hollow area, an internally threaded insert member receivable within said insert-receiving hollow area, and a leg extension member threadably received within said internally threaded insert member such that the height of said at least one of said leg members is adjustable by threadably rotating said leg extension member within said insert member, wherein said insert member includes first and second complimentary portions, each said portion carrying a section of a corresponding thread, such that said complimentary portions are positionable in a proximate position to form a substantially continuous thread therebetween, said thread of said first and second complimentary portions being female threads, a plurality of regularly spaced calibrating detents positioned on the crest of said female threads, wherein said leg extension member carries external male threads corresponding to said female threads of said insert member, said leg extension member also including an outwardly extending calibrating protrusion positioned between adjacent of said external threads and sequentially receivable within selected of adjacent said detents carried by said insert member, when said leg extension member is threadably received within said insert member.

10. A chair having adjustable height comprising a seat portion, a plurality of elongate leg members extending generally downwardly from said seat portion for supporting said seat portion, each said leg member having a first end and a second end, said first end positioned proximate to said seat portion, at least one of said leg members having a generally longitudinally extending insert-receiving hollow area therein and an aperture at said second end opening into said hollow area, an internally threaded insert member receivable within said insert-receiving hollow area, wherein said at least one of said leg members has four longitudinally extending ribs positioned in a regularly spaced, parallel manner proximate to said insert-receiving hollow area and at least partially protruding therein, such that said ribs physically engage said insert member when said insert member is received within said hollow area, and a leg extension member threadably received within said internally threaded insert member such that the height of said at least one of said leg members is adjustable by threadably rotating said leg extension member within said insert member.

* * * * *

UNITED STATES PATENT AND TRADEMARK OFFICE

CERTIFICATE OF CORRECTION

PATENT NO. : 5,536,068

DATED : July 16, 1996

INVENTOR(S) : Valentor et al.

It is certified that error appears in the above–identified patent and that said Letters Patent is hereby corrected as shown below:

Claim 1, column 5, line 53, after the word "portion" insert --,--.

Claim 1, column 5, line 54, the word "and" should read "end".

Claim 9, column 6, line 33, the word "elongated" should read "elongate"

Signed and Sealed this

Seventh Day of January, 1997

*Attest:*

Bruce Lehman

BRUCE LEHMAN

*Attesting Officer*

*Commissioner of Patents and Trademarks*